US007892650B2

(12) United States Patent
Suzuki et al.

(10) Patent No.: US 7,892,650 B2
(45) Date of Patent: Feb. 22, 2011

(54) MAGNESIUM ALLOY MEMBER, METHOD FOR PRODUCING THE SAME, AND TRANSPORTER COMPRISING THE SAME

(75) Inventors: Takaharu Suzuki, Shizuoka (JP); Junichi Inami, Shizuoka (JP); Toshikatsu Koike, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 428 days.

(21) Appl. No.: 12/136,899

(22) Filed: Jun. 11, 2008

(65) Prior Publication Data

US 2008/0308424 A1 Dec. 18, 2008

(30) Foreign Application Priority Data

Jun. 12, 2007 (JP) ..... 2007-155338

(51) Int. Cl.
*B32B 15/04* (2006.01)
*C22C 23/02* (2006.01)

(52) U.S. Cl. ..... 428/472; 428/472.2; 428/304.4; 428/469; 428/688; 428/689; 428/697; 428/699; 428/701; 428/702; 428/336; 420/407; 205/171

(58) Field of Classification Search ..... None
See application file for complete search history.

(56) References Cited

U.S. PATENT DOCUMENTS 4,978,432 A 12/1990 Schmeling et al.
2005/0072685 A1 4/2005 Ardelean et al.

FOREIGN PATENT DOCUMENTS

| | | | |
|---|---|---|---|
| JP | 55-54593 | A | 4/1980 |
| JP | 04-193998 | A | 7/1992 |
| JP | 2002-256494 | A | 9/2002 |
| JP | 2003-328188 | A | 11/2003 |
| JP | 2006-291278 | A | 10/2006 |
| JP | 2007-177262 | A | 7/2007 |
| WO | 02/28838 | A2 | 4/2002 |
| WO | 03/029529 | A1 | 4/2003 |

OTHER PUBLICATIONS

Official communication issued in counterpart European Application No. 08010621.4, mailed on Oct. 30, 2008.

Database WPI Week 197746; Thomson Scientific; London, GB; AN 1977-82558y; XP002498732; SU 536 257 A; Mar. 10, 1977; abstract.

*Primary Examiner*—Ling Xu
(74) *Attorney, Agent, or Firm*—Keating & Bennett, LLP

(57) ABSTRACT

A magnesium alloy member includes a member main body formed of a magnesium alloy containing aluminum, and an anodic oxidation coating covering at least a portion of the member main body. The anodic oxidation coating includes a porous first layer and a second layer located between the first layer and the member main body and having a higher aluminum content than that of the first layer. The ratio of the thickness of the second layer with respect to the thickness of the anodic oxidation preferably is about 5% to about 20%.

9 Claims, 10 Drawing Sheets

EDX ANALYSIS SITE

MAGNESIUM ALLOY MEMBER, METHOD FOR PRODUCING THE SAME, AND TRANSPORTER COMPRISING THE SAME

BACKGROUND OF THE INVENTION

1. Field of the Invention

The present invention relates to a magnesium alloy member, and in particular to a magnesium alloy member including an anodic oxidation coating. The present invention also relates to a method for producing such a magnesium alloy member and a transporter including such a magnesium alloy member.

2. Description of the Related Art

Conventionally, steel has widely been used as a material for transporters because of superior mechanical properties, superior processability and low cost thereof. In order to improve the fuel efficiency and running performance, however, transporters are desired to be more lightweight. Research has been made to use materials more lightweight than steel.

Recently, low-cost refining methods for titanium, aluminum, magnesium and the like, which have a lower specific gravity than that of steel, and methods for producing alloys containing such metal materials have been developed. Technologies for improving the strength and processability of alloys of such metal materials have also been developed.

In such a situation, it has been proposed to use alloys of titanium, aluminum and magnesium as materials for members of transporters. Particularly, when magnesium alloys are used, the weight of the transporters can be significantly reduced because the density of magnesium is about 23% of that of steel.

However, magnesium alloys are more likely to be corroded than aluminum alloys in certain environments. As one technique to improve the corrosion resistance of magnesium alloys, an anodic oxidation coating is formed on a surface of a magnesium alloy.

An anodic oxidation coating on an aluminum alloy is known to include a porous layer and a non-porous barrier layer. These layers can be observed by an electron microscope. An anodic oxidation coating on a magnesium alloy also includes a porous layer and a barrier layer as disclosed in Japanese Laid-Open Patent Publication No. 2006-291278.

This publication describes that the corrosion resistance of magnesium alloys can be improved by reducing an average diameter of micropores in a surface area of the porous layer from that in the conventional art to 100 nm to 25 μm.

However, transporters are mainly used outdoors and therefore members forming the transporters are often exposed to severe environments. Hence, magnesium alloys are desired to have more improved corrosion resistance.

Most of the magnesium alloy members practically used today are used for domestic electronic appliances, particularly for reducing the weight of small mobile devices. The magnesium alloy members for these applications are small interior components and are not required to have such a high corrosion resistance as is required of those used for transporters.

In general, as the anodic oxidation coating is thicker, the corrosion resistance is higher. An anodic oxidation coating formed on a magnesium alloy member used for domestic electronic appliances often has a thickness of about 5 μm to 15 μm. When an anodic oxidation coating of such a thickness is formed on a magnesium alloy member for transporters by a conventional technique, a sufficient corrosion resistance is not provided. Studies performed by the present inventors have found that a thickness exceeding 15 μm is required in order to guarantee a sufficient corrosion resistance for a magnesium alloy member used for transporters.

However, when the anodic oxidation coating is thickened, the porous layer is also thickened accordingly. A porous layer, which is mainly formed of magnesium oxide (MgO) or magnesium hydroxide (MgOH), has a convex and concave surface and thus is more brittle than the magnesium alloy which is the starting material. When the porous layer is thickened, and the height difference between the convex area and the concave area becomes large, such a location with a large height difference is likely to cause fatigue destruction and thus decrease the fatigue strength.

SUMMARY OF THE INVENTION

In order to overcome the problems described above, preferred embodiments of the present invention provide a method for improving the corrosion resistance of a magnesium alloy without increasing the thickness of the anodic oxidation coating, or even while further reducing the thickness of the anodic oxidation coating than that in the conventional art.

In addition, preferred embodiments of the present invention provide a magnesium alloy member which is superb both in corrosion resistance and fatigue strength, a method for producing the same, and a transporter including such a magnesium alloy member.

A preferred embodiment of the present invention provides a magnesium alloy member including a member main body formed of a magnesium alloy containing aluminum, and an anodic oxidation coating covering at least a portion of the member main body. The anodic oxidation coating includes a porous first layer and a second layer located between the first layer and the member main body and having a higher aluminum content than that of the first layer. The ratio of a thickness of the second layer with respect to a thickness of the anodic oxidation coating is preferably about 5% to about 20%, for example.

In one preferred embodiment, the aluminum content of the second layer is preferably about 10% by mass to about 20% by mass, for example.

In one preferred embodiment, the thickness of the anodic oxidation coating is preferably about 2 μm to about 5 μm, and the thickness of the second layer is preferably about 200 nm to about 500 nm, for example.

In one preferred embodiment, the first layer preferably has a porosity of about 10% or higher; and the second layer preferably has a porosity of lower than about 10%, for example.

In one preferred embodiment, the member main body preferably has an aluminum content of about 5.5% to about 10.0% by mass in an area within 100 μm from an interface with the anodic oxidation coating, for example.

In one preferred embodiment, the member main body preferably has an average crystalline diameter of 20 μm or smaller in an area within 100 μm from an interface with the anodic oxidation coating, for example.

In one preferred embodiment, the anodic oxidation coating preferably has a 10 point average surface roughness of 6.4 Rz or smaller at a surface thereof, for example.

Alternatively, a magnesium alloy member according to a preferred embodiment of the present invention includes a member main body formed of a magnesium alloy containing aluminum; and an anodic oxidation coating covering at least a portion of the member main body. The anodic oxidation coating includes a porous first layer and a second layer located between the first layer and the member main body and having a higher aluminum content than that of the first layer. The anodic oxidation coating preferably has a thickness of about 2 μm to about 5 μm; and the second layer preferably has a thickness of about 200 nm to about 500 nm, for example.

A transporter according to a preferred embodiment of the present invention includes a magnesium alloy member having the above-described structure.

A method for producing a magnesium alloy member according to a preferred embodiment of the present invention includes the steps of preparing a member main body formed of a magnesium alloy containing aluminum; and forming an anodic oxidation coating on a surface of the member main body. The step of forming the anodic oxidation coating is carried out by repeating, a plurality of times, an anodic oxidation step of treating the member main body with anodic oxidation at a prescribed voltage for a prescribed time period; and the anodic oxidation step at each of the second and subsequent times is carried out at a voltage higher than the voltage used for the immediately previous time.

In one preferred embodiment, the anodic oxidation step is carried out at a voltage of preferably about 40 V to about 150 V, for example.

In one preferred embodiment, the anodic oxidation step at each time is carried out for a time period of preferably about 0.001 seconds to about 120 seconds, for example.

In one preferred embodiment, the anodic oxidation step at each of the second and subsequent times is carried out at a voltage higher than the voltage used for the immediately previous time preferably by about 0.5 V to about 5.0 V, for example.

In one preferred embodiment, the anodic oxidation step is repeated at least five times.

In one preferred embodiment, the step of preparing the member main body includes the step of molding the member main body from the magnesium alloy containing aluminum by die-casting.

In one preferred embodiment, the method for producing a magnesium alloy member according to the present invention further includes the step of, before the step of forming the anodic oxidation coating, immersing the member main body in an acidic solution preferably having a concentration of about 0.1 mol/l to about 1.0 mol/l and a temperature of about 25° C. to about 40° C. for a time period of about 60 seconds to about 300 seconds, for example.

The anodic oxidation coating of the magnesium alloy member according to a preferred embodiment of the present invention includes a porous first layer and a second layer located between the first layer and the member main body and having a higher aluminum content than that of the first layer. In the magnesium alloy member according to a preferred embodiment of the present invention, the ratio of the thickness of the second layer with respect to the thickness of the anodic oxidation coating is preferably about 5% to about 20%, for example, which is higher than that in the conventional art. Therefore, the thickness of the second layer can be increased without particularly increasing the entire thickness of the anodic oxidation coating. This can further improve the corrosion resistance while preventing the decrease in the fatigue strength. In other words, the magnesium alloy member which is superb both in the fatigue strength and the corrosion resistance is obtained.

The aluminum content of the second layer preferably is typically about 10% by mass to about 20% by mass, for example.

Where the thickness of the anodic oxidation coating is about 2 μm to about 5 μm, a sufficient fatigue strength and a sufficient corrosion resistance are obtained by, for example, forming the second layer with a thickness which is about 200 nm to about 500 nm.

The first layer preferably has a porosity of about 10% or higher, whereas the second layer preferably has a porosity of lower than about 10%, and more preferably about 5% or lower.

It is preferable that the aluminum content in the vicinity of the surface of the member main body (more practically, an area within about 100 μm from the interface between the member main body and the anodic oxidation coating) preferably is about 5.5% to about 10.0% by mass, for example. When the aluminum content is lower than 5.5% by mass, the formation of spinel (an oxide of magnesium and aluminum as described below) is inhibited and thus the second layer having a sufficient thickness may not be formed. When the aluminum content is higher than about 10.0% by mass, the tenacity of the magnesium alloy is reduced to be inappropriate for being used for the magnesium alloy member.

During each anodic oxidation step, the dissolution of the member main body in the vicinity of the surface thereof and the generation of the anodic oxidation coating occur at the same time in parallel. Therefore, where the average crystalline diameter in the vicinity of the surface of the member main body is sufficiently small, the surface is unlikely to be roughened when the member main body is dissolved in the vicinity of the surface thereof and thus, variations in the thickness of the second layer (area-by area variance) can be prevented. Specifically, where the average crystalline diameter of the member main body in an area within about 100 μm from the interface with the anodic oxidation coating preferably is about 20 μm or smaller, the effect of suppressing the variance of the thickness of the second layer is large.

For the same reason (for the purpose of making the surface of the member main body less likely to be roughened when the member main body is dissolved in the vicinity of the surface so as to suppress the variance of the thickness of the second layer), it is preferable that the surface roughness of the member main body used for the anodic oxidation step is small. Specifically, the member main body preferably has a 10 point average surface roughness of 3.2 Rz or smaller, for example. When the anodic oxidation coating is formed on the member main body having a 10 point average surface roughness 3.2 Rz or smaller, the 10 point average surface roughness of the anodic oxidation coating is 6.4 Rz or smaller. More specifically, the magnesium alloy member in which the 10 point average surface roughness of the anodic oxidation coating is 6.4 Rz or smaller has a sufficiently small variance of the thickness of the second layer.

The magnesium alloy member according to the various preferred embodiments is superb in corrosion resistance and fatigue strength, and therefore is preferably used for various types of transporters.

According to the production method of a magnesium alloy member of a preferred embodiment of the present invention, the step of forming an anodic oxidation coating is carried out by repeating, a plurality of times, an anodic oxidation step of treating the member main body with anodic oxidation at a prescribed voltage for a prescribed time period. The anodic oxidation step at each of the second and subsequent times is carried out at a higher voltage than the voltage used for the immediately previous time. More specifically, during the step of forming the anodic oxidation coating, the applied voltage is raised step by step. Such a manner of forming the anodic oxidation coating allows the ratio of the thickness of the second layer with respect to the thickness of the anodic oxidation coating preferably to be about 5% to about 20%, which is higher than that in the conventional art. For this reason, the thickness of the second layer can be increased without increasing the entire thickness of the anodic oxidation coating. This can further improve the corrosion resistance while preventing the decrease in the fatigue strength. In other words, the magnesium alloy member which is superb both in fatigue strength and corrosion resistance is obtained.

Preferably, each anodic oxidation step is carried out at a voltage of about 40 V to about 150 V, for example. When the voltage is lower than about 40 V, the formation of spinel is inhibited and thus the second layer having a sufficient thickness may not be formed. When the voltage is higher than about 150 V, the thickness of the second layer is varied and is not likely to be uniform, which may reduce the productivity.

Preferably, each anodic oxidation step is carried out for a time period of about 0.001 to about 120 seconds, for example. It is basically more preferable as the time spent for each anodic oxidation step is shorter. However, when the time period is shorter than about 0.001 seconds, the time of voltage application is excessively short and the generation rate of the coating may be significantly reduced. In consideration of the cost and productivity, the time period for each anodic oxidation step is preferably about 0.001 seconds or longer. When the time period is longer than about 120 seconds, the growth rate of the first layer is increased and thus the ratio of the thickness of the second layer with respect to the entire thickness of the anodic oxidation coating is decreased. In order to keep high the ratio of the thickness of the second layer, the time period for each anodic oxidation step is preferably about 120 seconds or shorter, and more preferably 90 seconds or shorter.

In order to form the second layer efficiently, it is preferable that the difference in the voltage between one anodic oxidation step and the immediately subsequent anodic oxidation step is large to a certain degree. Specifically, it is preferable that the anodic oxidation step at each of the second and subsequent times is carried out at a voltage higher, for example, by at least about 0.5 V, than the voltage used for the immediately previous time. It should be noted that when the voltage difference is excessively large, it may be difficult to repeat the anodic oxidation step many times and still maintain the voltage in the final anodic oxidation step (final voltage) at a level which is unlikely to vary the thickness of the second layer (for example, about 150 V or lower as described above). Therefore, the anodic oxidation step at each of the second and subsequent times is preferably carried out at a voltage which is not different, by more than about 5.0 V, than the voltage used for the immediately previous time. Consequently, the anodic oxidation step at each of the second and subsequent times is preferably carried out at a voltage which is higher, for example, by about 0.5 V to about 5.0 V, than the voltage used for the immediately previous time.

In order to increase the ratio of the thickness of the second layer with respect to the thickness of the anodic oxidation coating, it is preferable to carry out the anodic oxidation step at least a certain number of times. Specifically, it is preferable to carry out the anodic oxidation step at least five times.

The step of preparing the member main body preferably includes the step of molding the member main body from the magnesium alloy containing aluminum by die-casting. With die-casting, the molten magnesium alloy containing aluminum is rapidly cooled. This allows the average crystalline diameter in the vicinity of the surface of the member main body to be smaller than that of an inner portion of the member main body.

Before the step of forming the anodic oxidation coating, the step may be carried out of immersing the member main body in an acidic solution having a concentration of about 0.1 mol/l to about 1.0 mol/l and a temperature of about 25° C. to about 40° C. for a time period of about 60 seconds to about 300 seconds, for example. Thus, the surface roughness of the member main body can be sufficiently decreased (for example, to a 10 point average surface roughness of 3.2 Rz or smaller).

According to the preferred embodiments of the present invention, a magnesium alloy member which is superb both in corrosion resistance and fatigue strength, and a method for producing the same are provided. Also according to another preferred embodiment of the present invention, a transporter including such a magnesium alloy member is provided.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, the present invention will be described by way of preferred embodiments with reference to the drawings. The present invention is not limited in any way by the following preferred embodiments.

Figure 1:
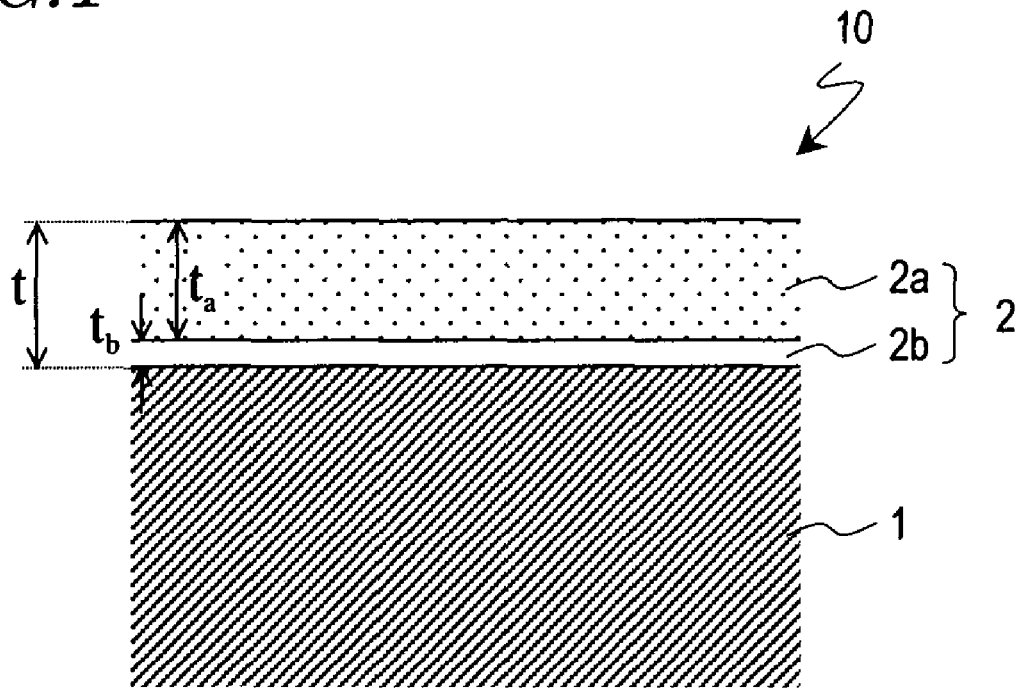
FIG. 1 schematically shows a cross-sectional structure of a magnesium alloy member 10 according to a preferred embodiment of the present invention.

FIG. 1 shows a cross-section of a magnesium alloy member (hereinafter, also referred to simply as the "member") 10 according to a preferred embodiment. As shown in FIG. 1, the member 10 includes a member main body 1 and an anodic oxidation coating 2 covering at least a portion of the member main body 1. Although not shown in FIG. 1, the anodic oxidation coating 2 may be coated with a paint film when necessary.

The member main body 1 is formed of a magnesium alloy containing aluminum. As the magnesium alloy, any of various compositions is usable. Examples of usable additive elements other than aluminum include manganese, zinc, calcium, rare earth elements and the like. The member main body 1 is molded into a prescribed shape by, for example, casting.

The anodic oxidation coating 2 has a multiple layer structure, and includes a first layer 2*a* which is a porous layer, and a second layer 2*b* located between the first layer 2 and the member main body 1. In other words, the anodic oxidation coating 2 includes the second layer 2*b* and the first layer 2*a* stacked in this order from the member main body 1 side.

The first layer 2*a* is mainly formed of magnesium oxide (MgO) and magnesium hydroxide (MgOH), and is porous as described above. By contrast, the second layer 2*b* is mainly formed of spinel. Spinel is an oxide of magnesium and aluminum, and has a stoichiometric composition of $AlMg_2O_4$ (not necessarily limited to this, needless to say). As is seen from the formula of the main component, the second layer 2*b* has a higher aluminum content than that of the first layer 2*a* and is substantially non-porous. Hereinafter, the porous first layer 2*a* will also be referred to as the "porous layer", and the non-porous second layer 2*b* will also be referred to as the "barrier layer". The barrier layer 2*b* is a layer which is first formed when the member main body 1 is treated with anodic oxidation. The porous layer 2*a* is formed on the barrier layer 2*b* after the barrier layer 2*b* is formed.

The porous layer 2*a* preferably has a porosity of about 10% to about 50%, whereas the barrier layer 2*b* preferably has a porosity of lower than about 10%, and more preferably about 5% or lower. The aluminum content of the porous layer 2*a* is preferably about 1% by mass to about 10% by mass, whereas the aluminum content of the barrier layer 2*b* is preferably about 10% by mass to about 20% by mass.

The porous layer 2*a* preferably has an average pore diameter of micropores of about 10 nm to about 4.5 μm, whereas the average pore diameter of the non-porous barrier layer 2*b* is not defined (needless to say, there are a very small number of holes in actuality).

In the magnesium alloy member 10 according to the present preferred embodiment, the ratio of a thickness $t_b$ of the barrier layer 2*b* with respect to a thickness t of the anodic oxidation coating 2 preferably is about 5% to about 20%, for example. By contrast, in the conventional magnesium alloy member, the ratio of the thickness of the barrier layer with respect to the thickness of the anodic oxidation coating preferably is about 1% or higher but lower than about 5%.

The porous layer 2*a* is porous and has a higher porosity than that of the barrier layer 2*b*. Therefore, the actual thickness of the porous layer 2*a* is locally varied, and the porous layer 2*a* has a portion having a very small thickness. By contrast, the barrier layer 2*b* is non-porous and has a lower porosity than that of the porous layer 2*a*. Therefore, the thickness of the barrier layer 2*b* is less varied than that of the porous layer 2*a*. For this reason, the corrosion resistance of the entire anodic oxidation coating 2 can be uniformly improved by forming the barrier layer 2*b* so as to be thick. More specifically, the barrier layer 2*b* significantly contributes to the improvement of the corrosion resistance.

In the present preferred embodiment, as described above, the ratio of the thickness $t_b$ of the barrier layer 2*b* with respect to the thickness t of the anodic oxidation coating 2 preferably is about 5% to about 20%, which is higher than that in the conventional art. Therefore, the thickness $t_b$ of the barrier layer 2*b* can be increased without particularly increasing the entire thickness t of the anodic oxidation coating 2 or a thickness $t_a$ of the porous layer 2*a*. This can further improve the corrosion resistance while suppressing the decrease in the fatigue strength. In other words, the magnesium alloy member 10 which is superb both in fatigue strength and corrosion resistance is obtained. The anodic oxidation coating 2 in which the thickness $t_b$ of the barrier layer 2*b* has a higher ratio than in the conventional art with respect to the thickness t of the anodic oxidation coating 2 can be produced by, for example, the following technique.

Where, for example, the entire thickness t of the anodic oxidation coating 2 preferably is about 2 μm to about 5 μm, a sufficient fatigue strength and a sufficient corrosion resistance are obtained by forming the barrier layer 2*b* with a thickness which preferably is about 200 nm to about 500 nm, for example.

Figure 2:
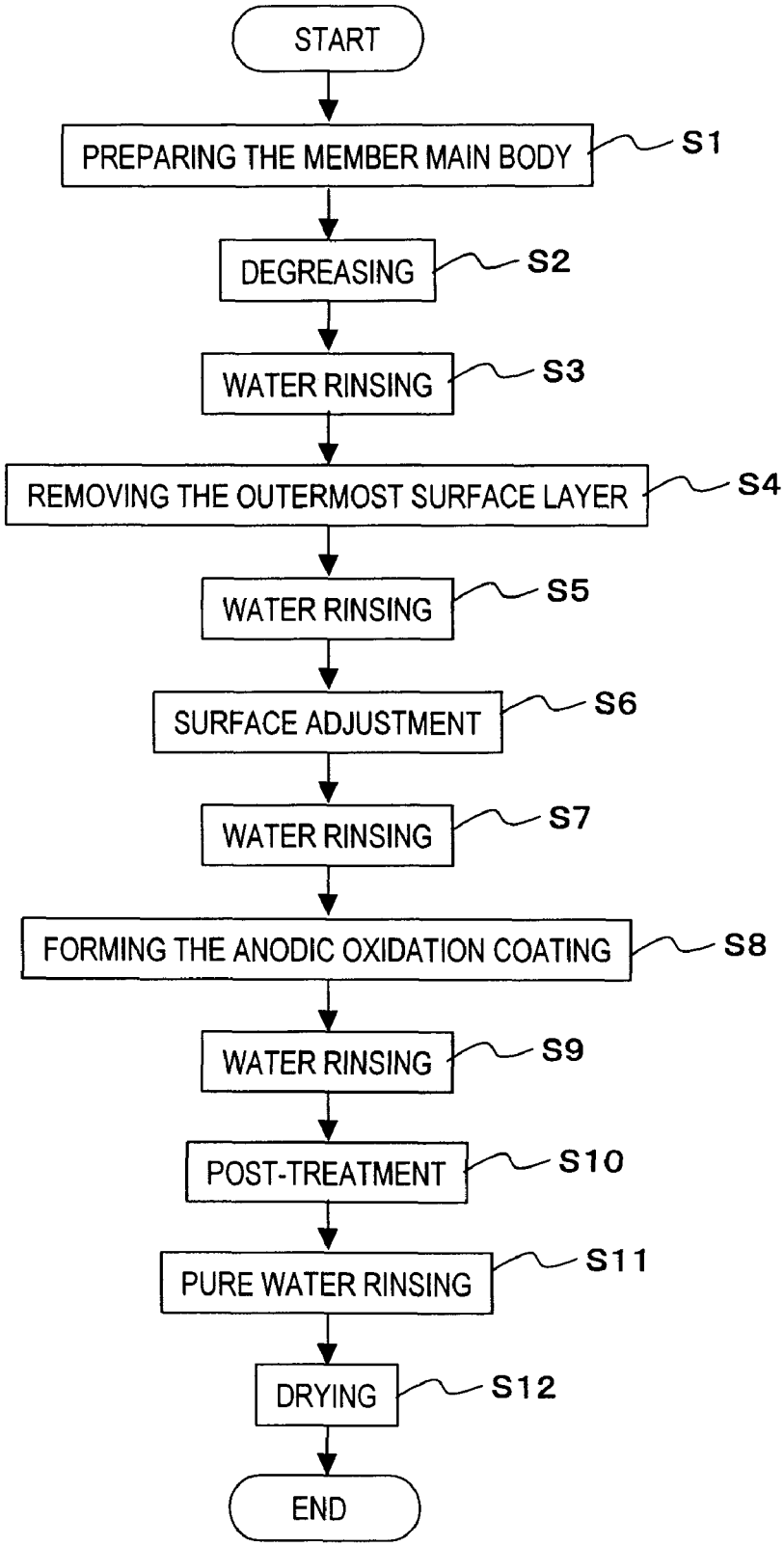
FIG. 2 is a flowchart schematically illustrating a method for producing the magnesium alloy member 10.

Now, with reference to FIG. 2, a method for producing the magnesium alloy member 10 according to the present preferred embodiment will be described. FIG. 2 is a flowchart illustrating the method for producing the magnesium alloy member 10.

First, the member main body 1 formed of a magnesium alloy containing aluminum is prepared (step S1). Preferably, the member main body 1 has a higher aluminum content in the vicinity of a surface thereof (i.e., in the vicinity of the anodic oxidation coating 2 to be formed later) than in a central area in a thickness direction thereof. The barrier layer 2*b* is a layer formed by oxidizing a portion of the member main body 1 in the vicinity of the surface thereof. Therefore, in the case where the member main body 1 has a higher aluminum content in the vicinity of the surface, the barrier layer 2*b* having a larger thickness can be formed than in the case where the aluminum content is substantially the same throughout the entirety of the member main body 1 even though the amount of aluminum is the same.

The member main body 1 may be formed by any of various known methods, but metal mold casting with a high cooling rate, especially die-casting is preferable. With die-casting, the molten magnesium alloy containing aluminum is rapidly cooled. This allows the aluminum content in the vicinity of the surface of the member main body 1 to be higher than that of an inner portion of the member main body 1. For the reasons described below, it is preferable that the magnesium alloy has a smaller average crystalline diameter in the vicinity of the surface of the member main body 1 than in the inner portion thereof. This is made possible by die-casting.

It is preferable that the aluminum content in the vicinity of the surface of the member main body 1 (more practically, an area within about 100 μm from an interface between the member main body 1 and the anodic oxidation coating 2) preferably is about 5.5% by mass to about 10.0% by mass, for example. When the aluminum content is lower than about 5.5% by mass, the formation of spinel is inhibited and thus the barrier layer 2*b* having a sufficient thickness may not be formed. When the aluminum content is higher than about 10.0% by mass, the tenacity of the magnesium alloy is reduced to be inappropriate for being used for the magnesium alloy member. The aluminum content in the vicinity of the surface of the member main body 1 preferably can be about 5.5% by mass to about 10.0% by mass by molding the member main body 1 by die-casting using a magnesium alloy such as, for example, AM60B, AM80, AZ91D, AZ61 or the like.

Next, the member main body 1 is sequentially treated with degreasing, water rinsing, removal of outermost surface layer, water rinsing, surface adjustment, and water rinsing (steps S2 through S7). Degreasing is to remove an oil component attached to the surface of the member main body 1. Removal of the outermost surface layer is to remove a contaminated surface layer from the surface of the member main body 1. Surface adjustment is to remove byproducts generated on the surface of the member main body 1 by the removal of the outermost surface layer and thus to clean the surface. These steps may be carried out by any of various known techniques. For example, the removal of the outermost surface layer may be performed mechanically or chemically. The steps from degreasing to surface adjustment are not absolutely necessary, but it is preferable to carry out these steps depending on the member main body 1. For example, in the case where the member main body 1 is a die-cast mold with a release agent attached thereto, it is preferable to carry out these steps.

Next, the anodic oxidation coating 2 is formed on the surface of the member main body 1 (step S8). This step of forming the anodic oxidation coating 2 is carried out by repeating, a plurality of times, an anodic oxidation step of treating the member main body 1 with anodic oxidation at a prescribed voltage for a prescribed time period.

Figure 3:
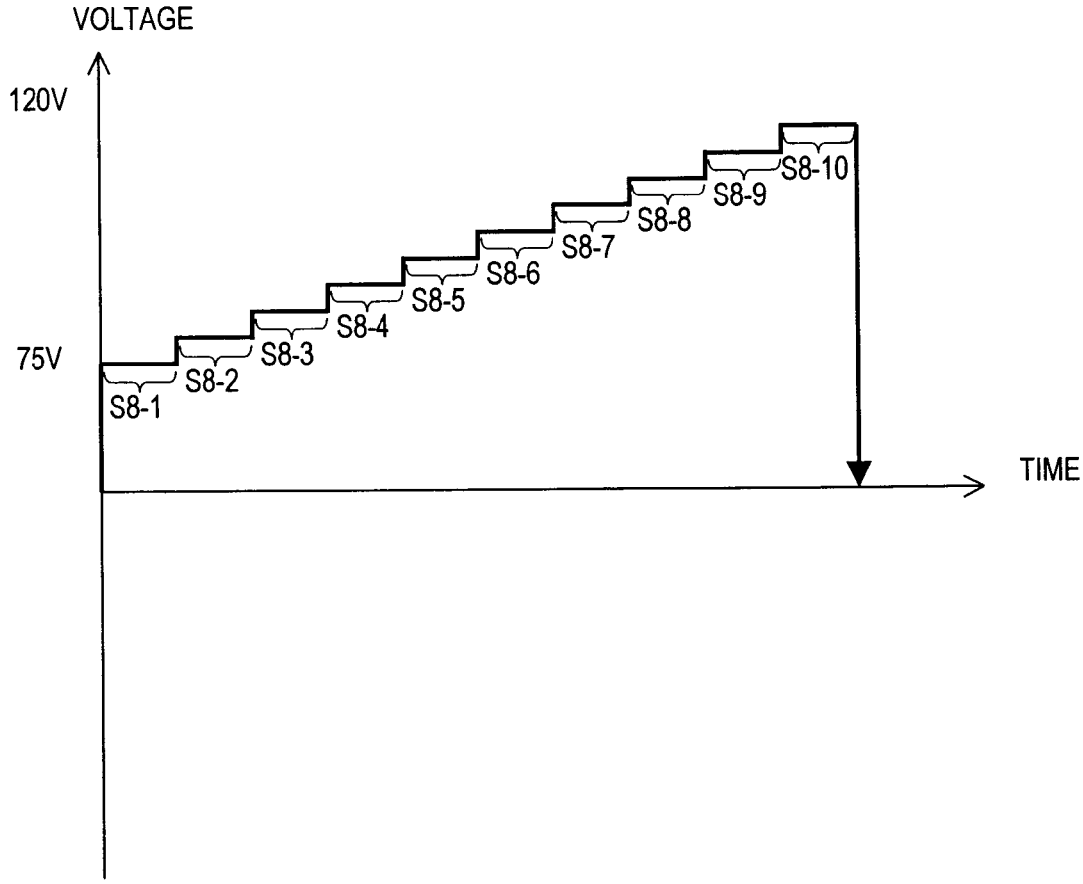
FIG. 3 is a graph showing an example of the relationship between the applied voltage and the time in the step of forming an anodic oxidation coating on the magnesium alloy member 10.

FIG. 3 shows an example of the relationship between the applied voltage and the time in step S8. In the example shown in FIG. 3, the anodic oxidation step is repeated 10 times (from steps S8-1 to S8-10). Also as shown in FIG. 3, the anodic oxidation step at each of the second and subsequent times is carried out at a voltage higher than the voltage used for the immediately previous time.

As an electrolyte for the anodic oxidation, an alkaline solution of any of various known compositions is usable. In examples described below, easily available alkaline solutions (aqueous solutions of $NaHCO_3$ or aqueous solutions of NaOH) having a concentration of about 0.5 to about 2 mol/l were preferably used.

As an electric current, a DC current is used but a PR current (having a DC-like waveform obtained as a result of a control on an AC current) is also usable. There is no specific limitation on the current density. In the examples, described below, the current density preferably was about 8 $A/dm^2$ to about 15 $A/dm^2$.

Then, water rinsing, post-treatment, pure water rinsing and drying are sequentially performed (steps S9 through S12). As the post-treatment, for example, pore closure treatment of closing the micropores on the surface of the anodic oxidation coating 2 is performed. Thus, the magnesium alloy member 10 including the anodic oxidation coating 2 is completed.

As described above, according to the production method in the present preferred embodiment, step S8 of forming the anodic oxidation coating 2 is carried out by repeating, a plurality of times, the anodic oxidation step of treating the member main body 1 with anodic oxidation at a prescribed voltage for a prescribed time period. The anodic oxidation step at each of the second and subsequent times is carried out at a voltage higher than the voltage used for the immediately previous time. More specifically, during the step of forming the anodic oxidation coating 2, the applied voltage is raised step by step. Such a manner of forming the anodic oxidation coating 2 allows the ratio of the thickness $t_b$ of the barrier layer 2*b* with respect to the thickness t of the anodic oxidation coating 2 preferably to be about 5% to about 20%, which is higher than that in the conventional art. The reason for this will now be described with reference to FIG. 4.

Figure 4:
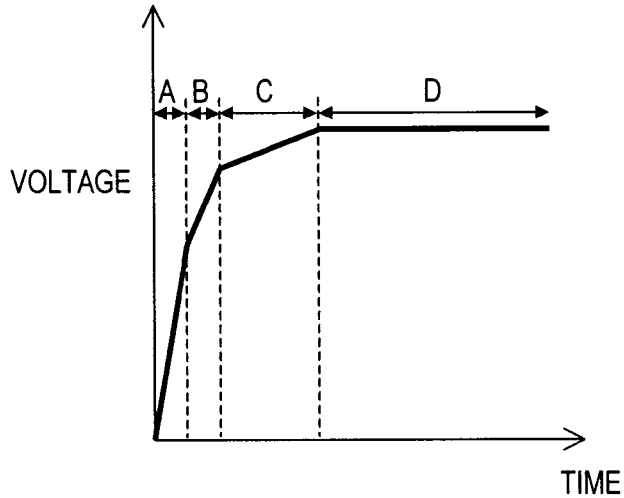
FIG. 4 is a graph showing a transition in the voltage at a surface of a member main body 1 of the magnetic alloy member 10 obtained when the member main body 1 is treated with anodic oxidation at a constant voltage.

FIG. 4 shows a transition in the voltage at the surface of the member main body 1 obtained when the member main body 1 is treated with anodic oxidation at a constant voltage. The voltage at the surface of the member main body 1 is gradually raised from immediately after the voltage application, and finally is converged to a certain value. Such a voltage transition is divided into four stages A through D by the generation state of the anodic oxidation coating 2.

In the first stage A, the voltage is rapidly raised, and the barrier layer 2*b* containing spinel as a main component is generated on the surface of the member main body 1. In the next stage B, the barrier layer 2*b* is generated as in the first stage A, but the voltage is raised more slowly and the generation rate of the barrier layer 2*b* is slower. In the next stage C, the porous layer 2*a* containing magnesium oxide or magnesium hydroxide containing as a main component is generated. The voltage keeps on rising slightly, and the barrier layer 2*b* is also generated although in a very small amount. In the final stage D, only the porous layer 2*a* is generated. The voltage is substantially converged to a constant value.

According to the production method in the present preferred embodiment, the anodic oxidation steps at each of the second and subsequent times is carried out at a higher voltage than the voltage used for the immediately previous time, so as to repeat the stages A and B (i.e., the stages in which the barrier layer 2*b* is generated). As a result, the ratio of the thickness $t_b$ of the barrier layer 2*b* with respect to the thickness t of the anodic oxidation coating 2 can be made higher (practically about 5% to about 20%, for example) than that in the conventional art. For this reason, the thickness $t_b$ of the barrier layer 2*b* can be increased without increasing the entire thickness t of the anodic oxidation coating 2. This can further improve the corrosion resistance while preventing the decrease in the fatigue strength. In other words, the magnesium alloy member 10, which is superb both in fatigue strength and corrosion resistance, is obtained.

Figure 5:
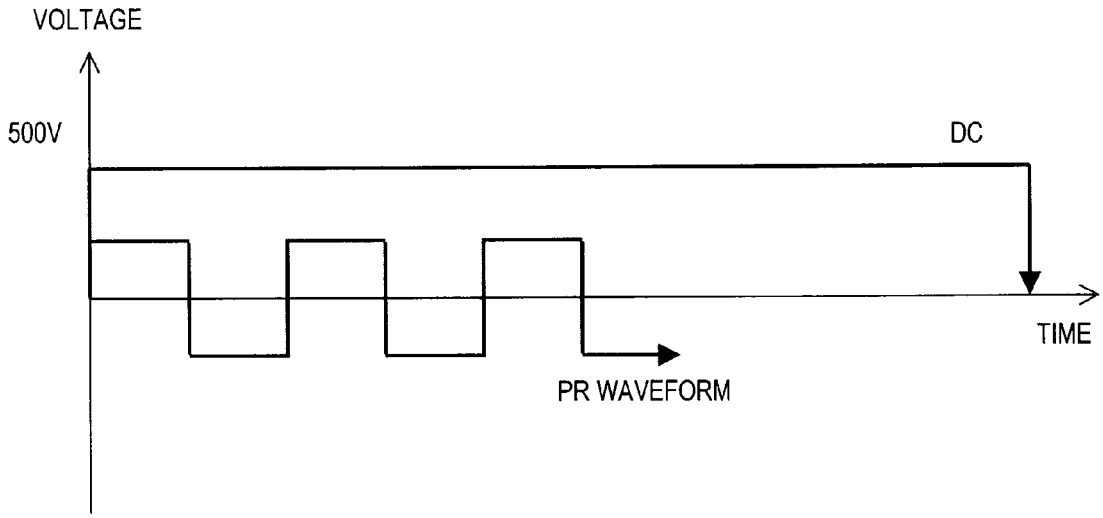
FIG.5 Prior Art
FIG. 5 is a graph showing the relationship between the applied voltage and the time in a conventional step of forming a conventional anodic oxidation coating.

By contrast, according to the conventional production method, as shown in FIG. 5, the anodic oxidation is performed at the same voltage throughout the step of forming the anodic oxidation coating. Therefore, the ratio of the thickness of the barrier layer with respect to the entire thickness of the anodic oxidation coating cannot be sufficiently high.

Figure 6:
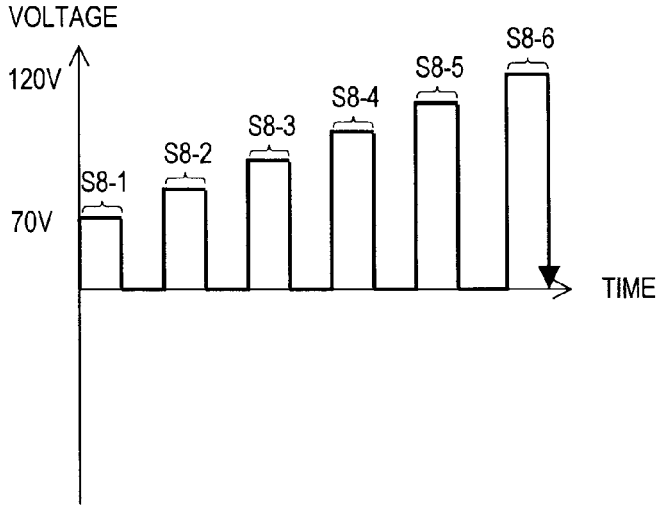
FIG. 6 is a graph showing another example of the relationship between the applied voltage and the time in the step of forming an anodic oxidation coating of the magnesium alloy member 10.

FIG. 3 shows the case where a plurality of anodic oxidation steps S8-1 through S8-10 with different applied voltages are continuously carried out. Alternatively, as shown in FIG. 6, anodic oxidation steps S8-1 through S8-6 may be carried out non-continuously, i.e., intermittently.

Preferably, each anodic oxidation step preferably is carried out at a voltage of about 40 V to about 150 V, for example. When the voltage is lower than about 40 V, the formation of spinel is inhibited and thus the barrier layer 2*b* having a sufficient thickness may not be formed. When the voltage is higher than about 150 V, the thickness $t_b$ of the barrier layer 2*b* is varied and is not likely to be uniform, which may reduce the productivity. In order to shorten the time required for performing the anodic oxidation step a plurality of times, the voltage for the first anodic oxidation step (starting voltage) is preferably about 75 V to about 120 V, for example.

Preferably, each anodic oxidation step is carried out for a time period of about 0.001 to about 120 seconds, for example. It is basically more preferable that the time spent for each anodic oxidation step is shorter. However, when the time period is shorter than about 0.001 seconds, the time of voltage application is excessively short and the generation rate of the coating may be significantly reduced. In consideration of the cost and productivity, the time period for each anodic oxidation step is preferably about 0.001 seconds or longer, for example. When the time period is longer than about 120 seconds, the growth rate of the first layer is increased and thus the ratio of the thickness $t_b$ of the second layer 2*b* with respect to the entire thickness t of the anodic oxidation coating 2 is decreased. In order to keep high the ratio of the thickness $t_b$ of the second layer 2*b*, the time period for each anodic oxidation step is preferably about 120 seconds or shorter, and more preferably about 90 seconds or shorter, for example. The entire step of forming the anodic oxidation coating 2 is typically carried out preferably for about 5 to about 50 minutes, for example.

In order to increase the ratio of the thickness $t_b$ of the barrier layer 2*b* with respect to the thickness t of the anodic oxidation coating 2, it is preferable to carry out the anodic oxidation step at least a certain number of times. Specifically, it is preferable to carry out the anodic oxidation step at least five times.

In order to repeat the steps A and B, it is preferable that the difference in the voltage between one anodic oxidation step and the immediately subsequent anodic oxidation step is large to a certain degree. Specifically, it is preferable that the anodic oxidation step at each of the second and subsequent times is carried out at a voltage higher by at least about 0.5 V than the voltage used for the immediately previous time. It should be noted that when the voltage difference is excessively large, it may be difficult to repeat the anodic oxidation step many times and still maintain the voltage in the final anodic oxidation step (final voltage) at a level which does not reduce the productivity (for example, about 150 V or lower as described above). Therefore, the anodic oxidation step at each of the second and subsequent times is preferably carried out at a voltage which is not different, for example, by more than about 5.0 V, from the voltage used for the immediately previous time. Namely, the anodic oxidation step at each of the second and subsequent times is preferably carried out at a voltage which is higher, for example, by about 0.5 V to about 5.0 V, than the voltage used for the immediately previous time.

During each anodic oxidation step, the dissolution of the member main body 1 in the vicinity of the surface thereof and the generation of the anodic oxidation coating 2 occur at the same time in parallel. Therefore, where the average crystalline diameter in the vicinity of the surface of the member main body 1 (average crystalline diameter of the magnesium alloy) is sufficiently small, the surface is unlikely to be roughened when the member main body 1 is dissolved in the vicinity of the surface thereof and thus the variance of the thickness $t_b$ of the barrier layer 2*b* (area-by area variance) can be suppressed. Specifically, where the average crystalline diameter of the member main body 1 in an area within about 100 μm from the interface with the anodic oxidation coating 2 is about 20 μm or smaller, the effect of suppressing the variance of the thickness $t_b$ of the barrier layer 2*b* is large.

For the same reason (for the purpose of making the surface of the member main body 1 less likely to be roughened when the member main body 1 is dissolved in the vicinity of the surface so as to suppress the variance of the thickness $t_b$ of the barrier layer 2*b*), it is preferable that the surface roughness of the member main body 1 used for the anodic oxidation step is small. Specifically, the member main body 1 preferably has a 10 point average surface roughness of about 3.2 Rz or smaller, for example. When the anodic oxidation coating 2 is formed on the member main body 1 having a 10 point average surface roughness about 3.2 Rz or smaller, the 10 point average surface roughness of the anodic oxidation coating 2 is about 6.4 Rz or smaller. More specifically, the magnesium alloy member 10, in which the 10 point average surface roughness of the anodic oxidation coating 2 preferably is about 6.4 Rz or smaller, is considered to have a sufficiently small variance of the thickness $t_b$ of the barrier layer 2.

The surface roughness of the member main body 1 can be decreased by performing a treatment for smoothing the surface of the member main body 1 during the step of removing the outermost surface layer (step S4 in FIG. 2).

Where, for example, the outermost surface layer is removed by mechanical polishing, the surface roughness of the member main body 1 can be decreased by using a fine grit polisher (for example, by polishing using emery paper of #400 to #500).

Where the outermost surface layer is removed by etching which is a chemical technique, the temperature and the concentration of the treating solution (etchant) may be reduced to extend the treating time than in the conventional art. Specifically, the surface roughness of the member main body 1 can be sufficiently decreased (for example, to a 10 point average surface roughness of about 3.2 Rz or smaller) by immersing the member main body 1 in an acidic solution having a concentration of about 0.1 mol/l to about 1.0 mol/l and a temperature of about 25° C. to about 40° C. (for example, a phosphoric acid solution or a nitric acid solution) for a time period of about 60 seconds to about 300 seconds, for example.

Figure 7:
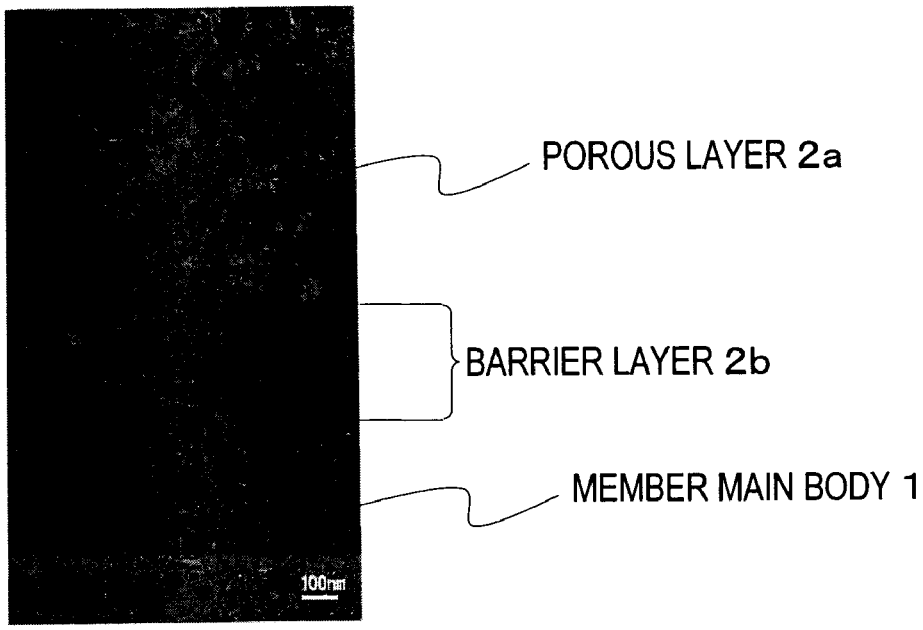
FIG. 7 is a micrograph of a cross-section of the magnesium alloy member 10.
Figure 8:
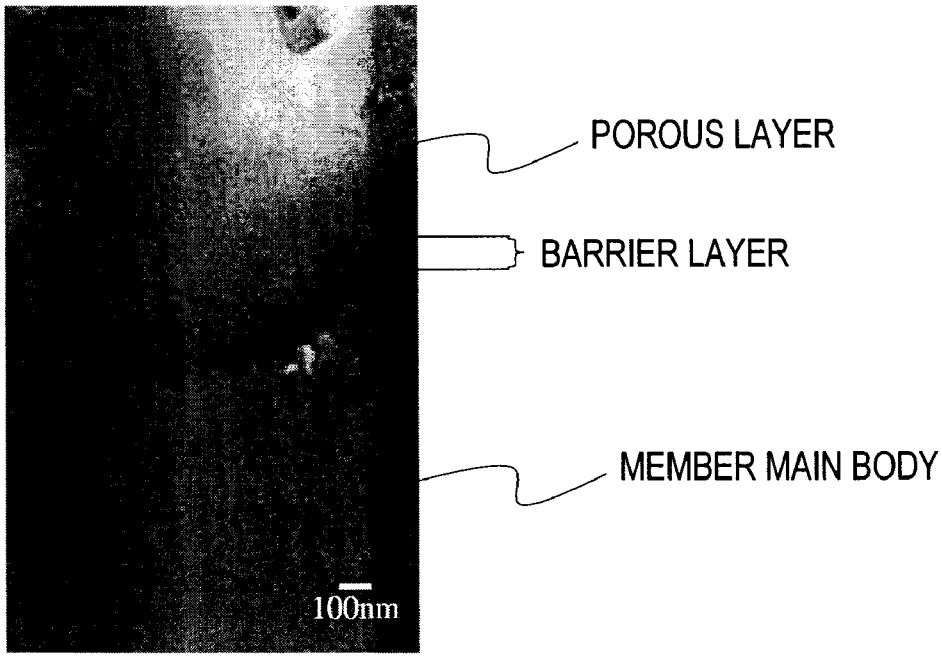
FIG. 8 Prior Art
FIG. 8 is a micrograph of a cross-section of a conventional magnesium alloy member.

FIG. 7 shows a micrograph of a cross-section of the magnesium alloy member 10 produced by the production method according to a preferred embodiment. FIG. 8 shows a micrograph of a cross-section of a magnesium alloy member produced by a conventional method. The cross-sections were observed using these micrographs to measure the thicknesses of the anodic oxidation coatings and the barrier layers. In the magnesium alloy member 10 shown in FIG. 7, the entire thickness t of the anodic oxidation coating 2 was about 5 μm or smaller, and the thickness $t_b$ of the barrier layer 2*b* was about 200 nm to about 500 nm. By contrast, in the conventional magnesium alloy member shown in FIG. 8, the thickness of the barrier layer was 60 nm to 300 nm, with the average value being smaller than 200 nm. Thus, the production method according to the present preferred embodiment can form the barrier layer 2*b* so as to be thicker than by the conventional method.

Figure 9:
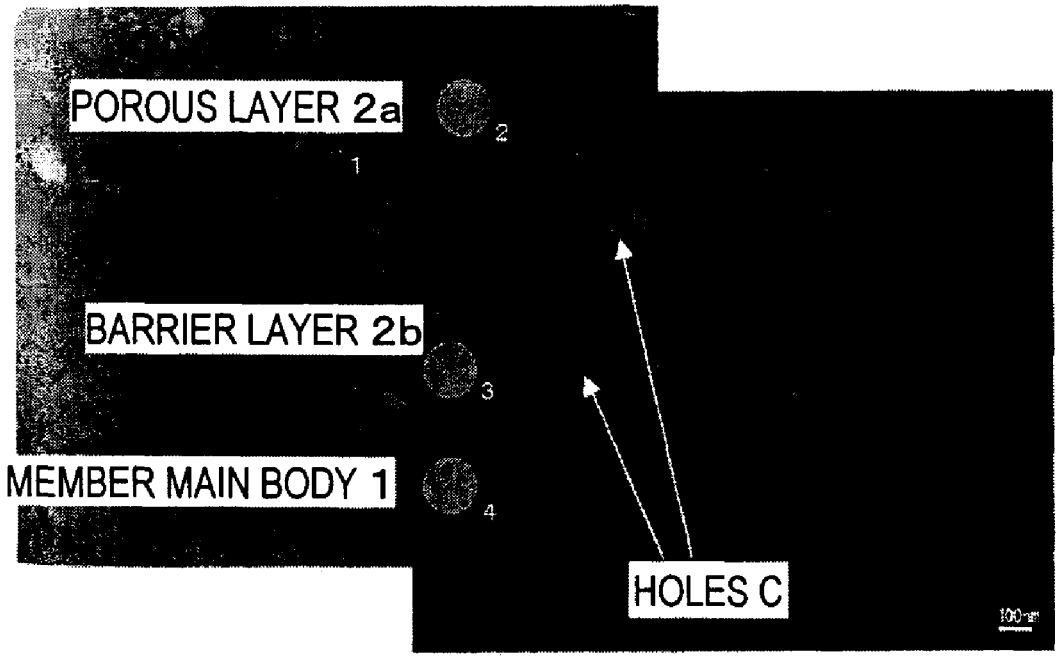
FIG. 9 is a micrograph showing the sites of the magnesium alloy member 10 subjected to EDX analysis.

Tables 1 and 2 show the results of EDX analysis (energy dispersive X-ray spectrometry) performed on the magnesium alloy member 10 produced by the production method according to the present preferred embodiment. As shown in FIG. 9, the EDX analysis was performed on four sites, i.e., analysis sites 1 and corresponding to the porous layer 2*a*, analysis site 3 corresponding to the barrier layer 2*b*, and analysis site 4 corresponding to the member main body 1.

TABLE 1

| Analysis site | O | Mg | Al |
|---|---|---|---|
| | | | % by mass |
| 1 | 38.00 | 57.17 | 4.83 |
| 2 | 37.95 | 57.42 | 4.63 |
| 3 | 46.64 | 42.12 | 11.24 |
| 4 | 8.89 | 82.93 | 8.18 |

TABLE 2

| Analysis site | O | Mg | Al |
|---|---|---|---|
| | | | % by atom |
| 1 | 48.42 | 47.93 | 3.65 |
| 2 | 48.36 | 48.15 | 3.49 |
| 3 | 57.56 | 34.21 | 8.23 |
| 4 | 13.01 | 79.89 | 7.10 |

As shown in Tables 1 and 2, the aluminum content of the barrier layer 2*b* is higher than that of the porous layer 2*a*. From this result, it is understood that the barrier layer 2*b* is mainly formed of spinel and the porous layer 2*a* is mainly formed of magnesium oxide or magnesium hydroxide.

Table 3 shows the results of evaluation of the corrosion resistance and the fatigue strength made on magnesium alloy members 10 produced by the production method according to the present preferred embodiment (Examples 1 through 6) and magnesium alloy members produced by conventional production methods (Comparative Examples 1 through 3). The corrosion resistance was evaluated by the salt spray (fog) testing conformed to ASTM-B-117, and the fatigue strength was evaluated by a plane bending fatigue test performed with a stress ratio of R=−1. The voltage application conditions and the time period of each anodic oxidation step in Examples 1 through 6 and Comparative Examples 1 through 3 shown in Table 3 are as shown in Table 4.

TABLE 3

| | Anodic oxidation coating thickness (μm) | Barrier layer thickness (μm) | Barrier layer thickness/ anodic oxidation coating thickness | Corrosion resistance | Fatigue strength decrease ratio |
|---|---|---|---|---|---|
| Example 1 | 3 | 0.3 | 10% | ○ | ○:5% |
| Example 2 | 4 | 0.4 | 10% | ○ | ○:10% |
| Example 3 | 5 | 0.25 | 5% | ○ | ○:10% |
| Example 4 | 2 | 0.4 | 20% | ○ | ○:5% |
| Example 5 | 2 | 0.2 | 10% | ○ | ○:5% |
| Example 6 | 5 | 0.5 | 10% | ○ | ○:10% |
| Comparative example 1 | 5 | 0.1 | 2% | X | ○:10% |
| Comparative example 2 | 8 | 0.2 | 2.5% | ○ | X:15% |
| Comparative example 3 | 15 | 0.2 | 1.3% | ○ | X:30% |

TABLE 4

| | Voltage application conditions | Time period of each anodic oxidation step |
|---|---|---|
| Example 1 | Starting voltage: 40 V; Increased by 0.5 V; Final voltage: 120 V | 1 sec. |
| Example 2 | Starting voltage: 60 V; Increased by 0.5 V; Final voltage: 140 V | 1 sec. |
| Example 3 | Starting voltage: 70 V; Increased by 1.0 V; Final voltage: 150 V | 1 sec. |
| Example 4 | Starting voltage: 60 V; Increased by 0.5 V; Final voltage: 110 V | 0.1 sec. |
| Example 5 | Starting voltage: 60 V; Increased by 1.0 V; Final voltage: 110 V | 1 sec. |
| Example 6 | Starting voltage: 40 V; Increased by 1.0 V; Final voltage: 140 V | 1 sec. |
| Comparative Example 1 | DC, 200 V | 30 min. |
| Comparative Example 2 | AC, 400 V, 1000 Hz | 10 min. |
| Comparative Example 3 | DC, 300 V | 45 min. |

As shown in Table 3, in Examples 1 through 6, the ratio of the thickness $t_b$ of the barrier layer 2*b* with respect to the thickness t of the anodic oxidation coating 2 is high (about 5% or higher and about 20% or lower). Owing to such a thick barrier layer 2*b*, the corrosion resistance is superb. Since the entire thickness t itself of the anodic oxidation coating 2 is not so large, the fatigue strength is also superb.

By contrast, in Comparative Examples 1 through 3, the ratio of the thickness of the barrier layer with respect to the thickness of the anodic oxidation coating is low (specifically, lower than 5%). For this reason, the barrier layer is excessively thin and thus the corrosion resistance is insufficient as in Comparative Example 1, or the anodic oxidation coating is excessively thick and thus the fatigue strength is insufficient as in Comparative Examples 2 and 3.

Table 4 shows that the time period for each anodic oxidation step is 1 or 0.1 seconds, as an example, in each of Examples 1 through 6, but the time period for each anodic oxidation step may be shorter, for example, 0.001 seconds.

Figure 10:
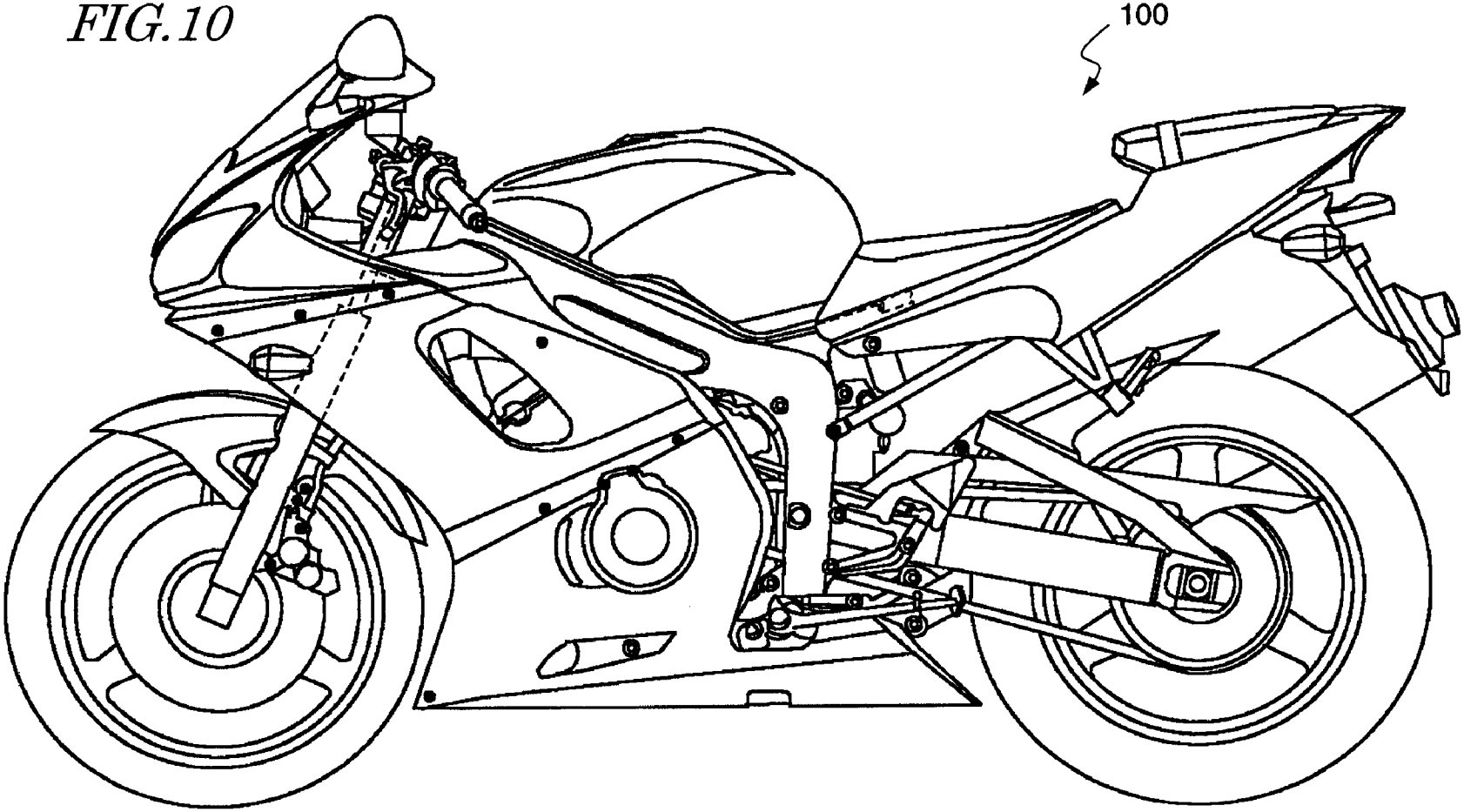
FIG. 10 is a side view schematically showing a motorcycle.

The magnesium alloy member 10 according to the various preferred embodiments is superb in corrosion resistance and fatigue strength, and therefore is preferably used for various types of transporters including a motorcycle 100 as shown in FIG. 10.

Transporters are mainly used outdoors and so the members forming the transporters are often exposed to severe environments. Use of the magnesium alloy member 10 according to preferred embodiments for a transporter reduces the weight thereof, prevents the corrosion even under severe environments, and improves the durability thereof.

Figure 11:
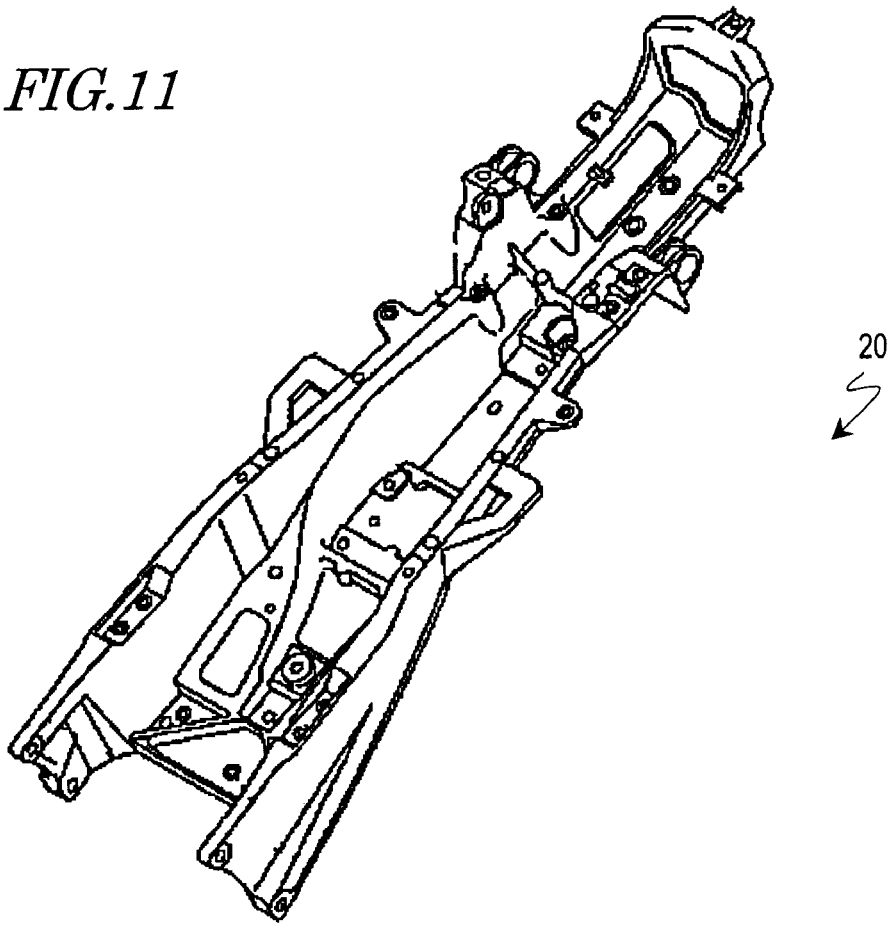
FIG. 11 is a perspective view schematically showing a frame of the motorcycle.
Figure 11:
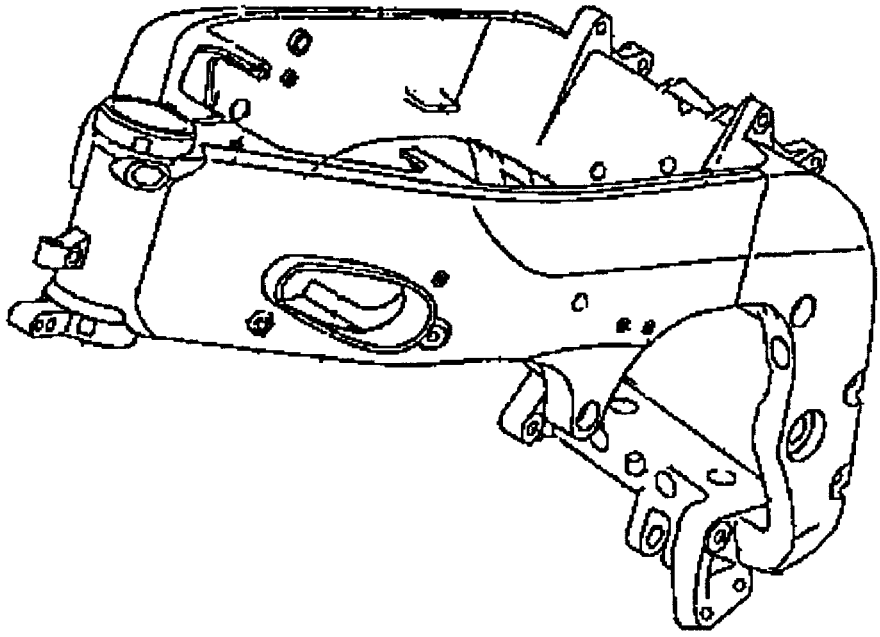
Figure 12:
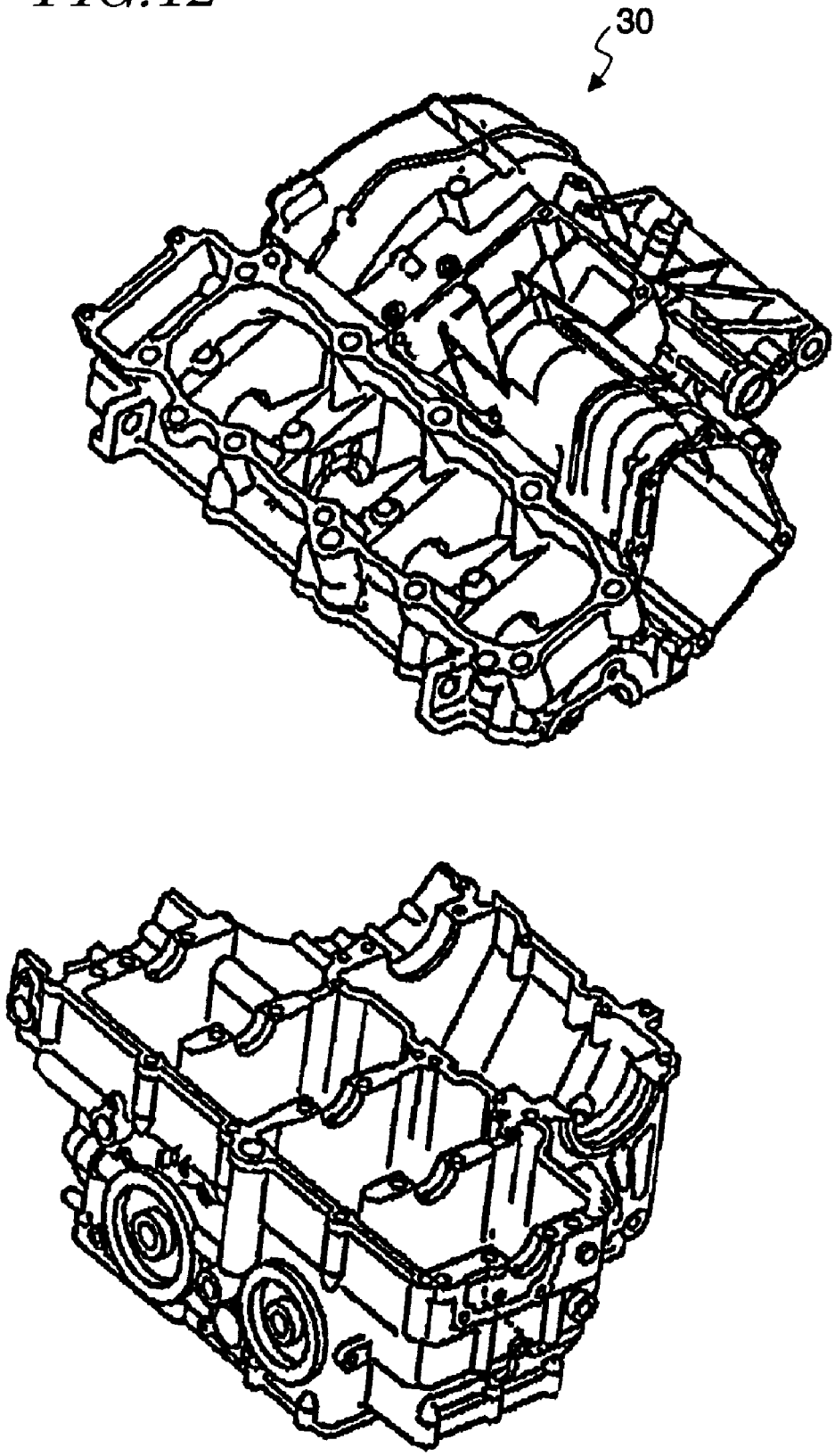
FIG. 12 is an exploded perspective view schematically showing a crankcase.
Figure 13:
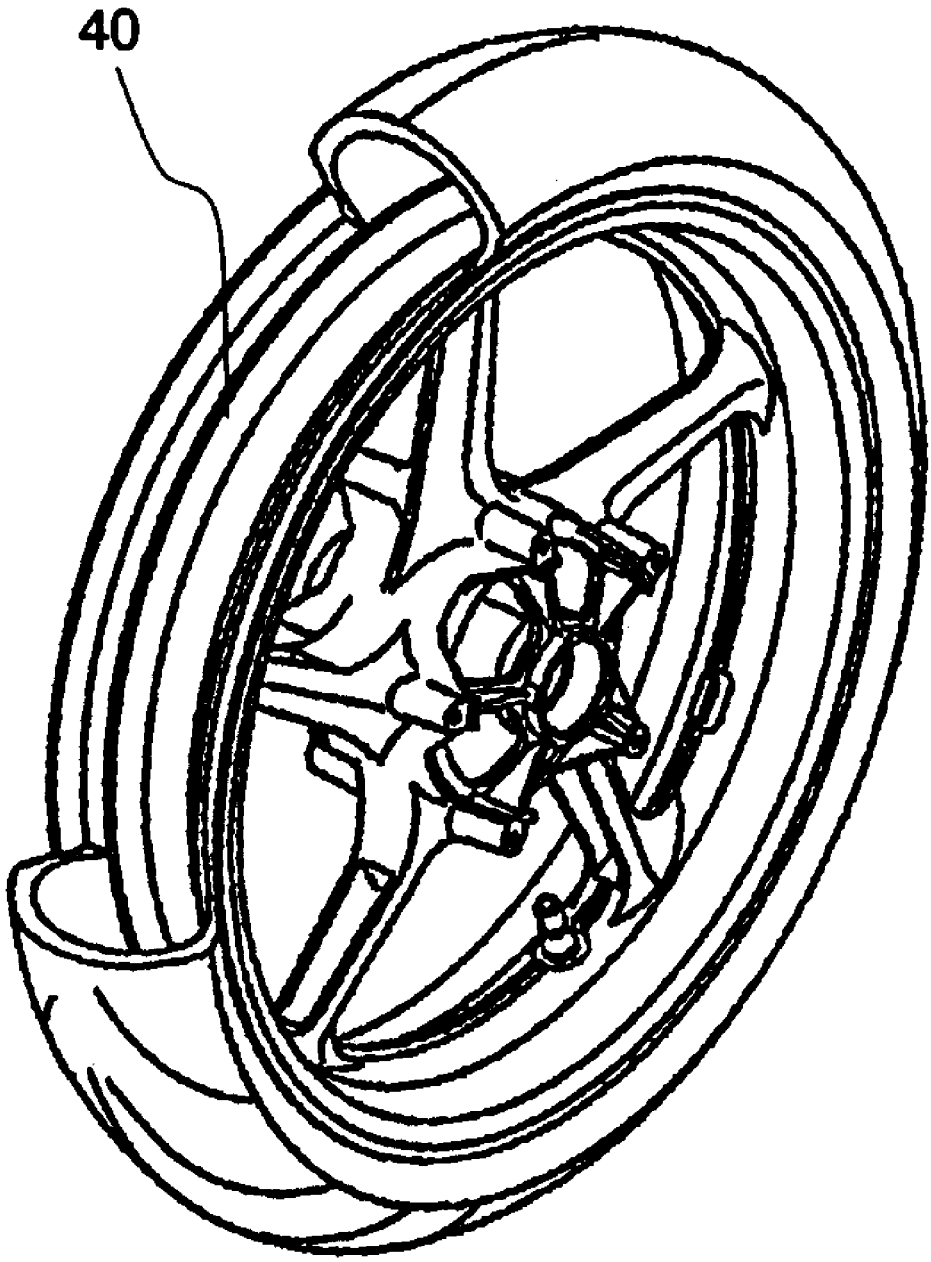
FIG. 13 is a perspective view schematically showing a wheel.

The magnesium alloy member 10 according to a preferred embodiment is, for example, a frame 20 of the motorcycle shown in FIG. 11. Alternatively, the magnesium alloy member 10 according to a preferred embodiment is, for example, a crankcase 30 shown in FIG. 12 or a wheel 40 shown in FIG. 13. Needless to say, the magnesium alloy member 10 according to the various preferred embodiments is not limited to being used for these exemplary applications, and may be preferably used as various other members of transporters.

According to the preferred embodiments of the present invention, a magnesium alloy member superb both in corrosion resistance and fatigue strength, and a method for producing the same, are provided. The magnesium alloy member according to the preferred embodiments of the present invention is widely usable for vehicles such as, for example, motorcycles and four-wheel automobiles and also various other transporters such as, for example, watercrafts and aircrafts.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Application No. 2007-155338 filed on Jun. 12, 2007, the entire contents of which are hereby incorporated by reference. Furthermore, the entire contents of Japanese Patent Application No. 2008-150210 filed on Jun. 9, 2008, are hereby incorporated by reference.

What is claimed is:

1. A magnesium alloy member, comprising:

a member main body made of a magnesium alloy containing aluminum; and an anodic oxidation coating covering at least a portion of the member main body; wherein the anodic oxidation coating includes a porous first layer and a second layer located between the first layer and the member main body and having a higher aluminum content than that of the first layer; and the ratio of a thickness of the second layer with respect to a thickness of the anodic oxidation coating is about 5% to about 20%.

2. The magnesium alloy member of claim 1, wherein the aluminum content of the second layer is about 10% by mass to about 20% by mass.

3. The magnesium alloy member of claim 1, wherein:

the thickness of the anodic oxidation coating is about 2 μm to about 5 μm; and the thickness of the second layer is about 200 nm to about 500 nm.

4. The magnesium alloy member of claim 1, wherein:

the first layer has a porosity of about 10% or higher; and the second layer has a porosity of lower than about 10%.

5. The magnesium alloy member of claim 1, wherein the member main body has an aluminum content of about 5.5% by mass to about 10.0% by mass in an area within about 100 μm from an interface with the anodic oxidation coating.

6. The magnesium alloy member of claim 1, wherein the member main body has an average crystalline diameter of about 20 μm or smaller in an area within about 100 μm from an interface with the anodic oxidation coating.

7. The magnesium alloy member of claim 1, wherein the anodic oxidation coating has a 10 point average surface roughness of about 6.4 Rz or smaller at a surface thereof.

8. A magnesium alloy member, comprising:

a member main body formed of a magnesium alloy containing aluminum; and an anodic oxidation coating covering at least a portion of the member main body; wherein the anodic oxidation coating includes a porous first layer and a second layer located between the first layer and the member main body and having a higher aluminum content than that of the first layer;

the anodic oxidation coating has a thickness of about 2 μm to about 5 μm; and the second layer has a thickness of about 200 nm to about 500 nm.

9. A transporter comprising a magnesium alloy member of claim 1.

* * * * *